US006854306B2

(12) United States Patent
Furlong

(10) Patent No.: US 6,854,306 B2
(45) Date of Patent: Feb. 15, 2005

(54) SELF-CONTAINED LOCK ASSEMBLY

(75) Inventor: Jonathan W. Furlong, Colorado Springs, CO (US)

(73) Assignee: Schlage Lock Company, Indianapolis, IN (US)

( * ) Notice: Subject to any disclaimer, the term of this patent is extended or adjusted under 35 U.S.C. 154(b) by 0 days.

(21) Appl. No.: 10/379,842

(22) Filed: Mar. 5, 2003

(65) Prior Publication Data

US 2004/0172993 A1 Sep. 9, 2004

(51) Int. Cl.[7] ..... E05B 27/00
(52) U.S. Cl. ..... 70/379 R; 70/367
(58) Field of Search ..... 70/379 R, 367–371, 70/380, 379 A; 292/358

(56) References Cited

U.S. PATENT DOCUMENTS

| | | | | | |
|---|---|---|---|---|---|
| 1,565,558 | A | | 12/1925 | Fremon | |
| 2,138,856 | A | * | 12/1938 | Harp | 70/216 |
| 2,176,800 | A | | 10/1939 | Moninger | |
| 2,347,802 | A | | 5/1944 | Voight | |
| 3,324,693 | A | | 6/1967 | Check | |
| 3,434,316 | A | * | 3/1969 | Neary | 70/371 |
| 3,603,123 | A | | 9/1971 | Best | |
| 4,123,926 | A | | 11/1978 | Elder | |
| 4,294,093 | A | | 10/1981 | Best et al. | |
| 4,404,825 | A | | 9/1983 | Dixon | |
| 4,444,034 | A | | 4/1984 | Best et al. | |
| 4,689,977 | A | * | 9/1987 | Wolniak et al. | 70/379 R |
| 4,715,201 | A | | 12/1987 | Craig | |
| 5,070,715 | A | | 12/1991 | Smallegan et al. | |
| 5,123,268 | A | | 6/1992 | Eizen | |
| 5,605,064 | A | * | 2/1997 | Katayama et al. | 70/224 |
| 5,848,540 | A | * | 12/1998 | Pieper | 70/252 |
| 6,105,405 | A | * | 8/2000 | Westwinkel | 70/371 |
| 6,109,080 | A | * | 8/2000 | Chen et al. | 70/371 |
| 6,382,006 | B1 | | 5/2002 | Field et al. | |
| 6,532,779 | B2 | * | 3/2003 | Shen | 70/224 |
| 2002/0073754 | A1 | * | 6/2002 | Katagiri et al. | 70/379 R |
| 2003/0159479 | A1 | * | 8/2003 | Kajuch et al. | 70/379 R |
| 2003/0167809 | A1 | * | 9/2003 | Huang | 70/379 R |

* cited by examiner

*Primary Examiner*—John B. Walsh
(74) *Attorney, Agent, or Firm*—Michael Best & Friedrich, LLP

(57) ABSTRACT

A throw member having a first and second hub located along a blade that couples the rotation of the core cylinder with the rotation of the key cam of a lock chassis to lock and unlock a lock assembly. The two hubs are spaced apart to receive a catch. The catch constrains the throw member from releasing when the core cylinder or door lever is exchanged or modified. In addition, the two hubs enhance the throw member's ability to prevent unauthorized removal of the door lever. One of the two hubs includes a passage to release the throw member from the catch.

19 Claims, 1 Drawing Sheet

SELF-CONTAINED LOCK ASSEMBLY

FIELD OF THE INVENTION

The present invention relates to a lock assembly. In particular, the present invention relates to a lock assembly that includes a self-contained throw member.

BACKGROUND OF THE INVENTION

In general, door lock assemblies are actuated by levers or knobs. Many door levers include a core cylinder with lock key mechanism for locking and unlocking the lock assembly. For these types of lock assemblies, consumers and manufacturers desire a lock assembly having a door lever and/or core cylinder that is readily exchangeable as well as secure.

SUMMARY OF THE INVENTION

The present invention provides a throw member located in the drive spindle that couples the core cylinder with the lock. The throw member of the invention enhances a lock assembly having a core cylinder, because the core cylinder can be exchanged or modified without the throw member coming loose. In addition, the throw member can be inserted or removed without the use of additional tools.

In one embodiment, the invention provides a throw member for a lock assembly, the throw member including a blade having a first end and a second end, the second end for engaging a key cam operable in retracting the lock assembly, a first hub located at the first end of the blade, a second hub located at a distance along the blade apart from the first hub, and an extension to the first hub for engaging a core cylinder having a key mechanism, wherein rotation of a key inside the key mechanism of the core cylinder is operable in rotating the throw member and key cam of the chassis in retracting the lock assembly.

In another embodiment, the invention provides a lock assembly for a door, the lock assembly including a latch assembly and chassis having a key cam operable in locking and unlocking the lock assembly, a door lever having a core cylinder with a key mechanism for locking and unlocking the lock assembly, a drive spindle that connects the door lever to the latch assembly, wherein rotation of the lever and spindle extends and retracts a latch, and a throw member positioned in the drive spindle, the throw member having a first and second hub positioned along a blade, wherein a first end of the throw member engages the core cylinder and a second end of the throw member engages the key cam, and wherein rotation of a key inside the key mechanism of the core cylinder is operable in rotating the throw member and key cam in retracting and extending the lock assembly.

Briefly summarized, the throw member of the invention provides manufacturers with an enhanced apparatus that couples a core cylinder having a key mechanism or key hole with a chassis having a key cam that locks and unlocks the lock assembly. Additionally, the throw member of the invention is accessible in the drive spindle and does not to come loose when the core cylinder or door lever is exchanged or modified. In further addition, the throw member of the invention prevents unauthorized removal of the door lever, and can be installed without using special tools or additional retaining mechanisms.

As is apparent from the above, it is an aspect of the invention to provide a lock assembly that includes a self-contained throw member. Other features and aspects of the invention will become apparent by consideration of the detailed description and accompanying drawings.

DETAILED DESCRIPTION

Figures 1, 2:
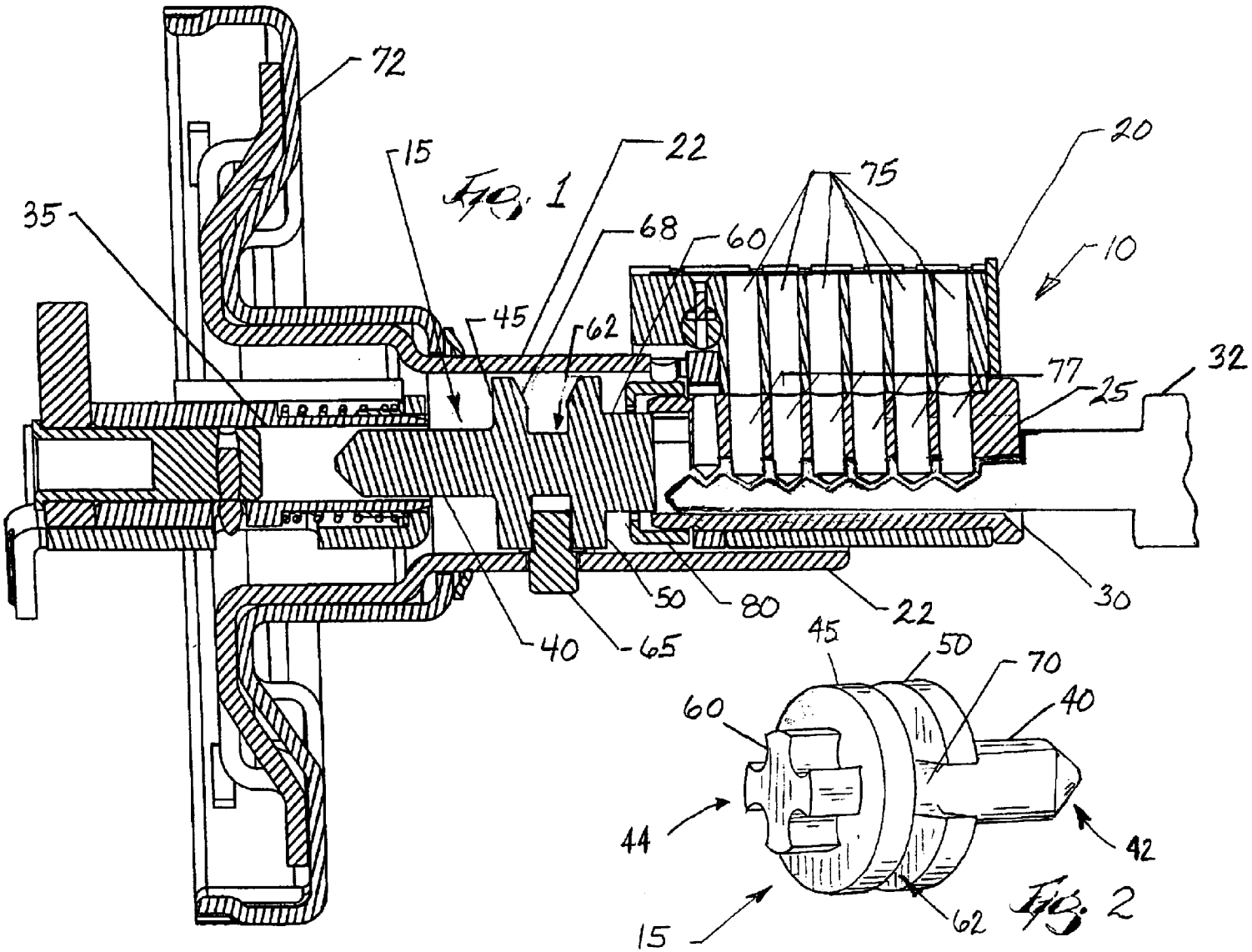
FIG. 1 is a partial cross-sectional view of a lock assembly embodying the invention.
FIG. 2 is a perspective view of a throw member embodying the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

FIG. 1 illustrates a partial cross-sectional view of a lock assembly 10 that includes a throw member 15 of the invention. A door lever (not shown) is connected to a drive spindle 22 that rotates to actuate a latch (not shown) of the lock assembly 10 between and an extended and a retracted position. The door lever includes a core cylinder 25 having a mechanism or key hole 30 for accepting a key 32 of a user in locking and unlocking the lock assembly 10. The throw member 15 couples the core cylinder 25 with a key cam 35 of the chassis of the lock assembly 10 to lock and unlock the lock assembly 10.

FIG. 2 shows a perspective view of the throw member 15 of the invention. The throw member 15 includes a blade 40 having a first end 42 and a second end 44. The first end 42 of the blade 40 is designed to engage the key cam 35 of the chassis. The key cam 35 rotates to lock or unlock the lock assembly 10. One embodiment of the blade 40 of the throw member 15 is generally square-shaped to engage the key cam 35 of the chassis. Another embodiment of the blade 40 can include a first end 42 that is narrowed to engage the key cam 35. Of course, the shape and thickness of the blade 40 can vary to be compatible in engaging the key cam 35 and is not limiting on the invention.

The other or second end 44 of the blade 40 is integral with a first hub 45. One embodiment of the first hub 45 is substantially cylindrical-shaped with a diameter to substantially fill the interior or cavity of the drive spindle 22. Of course, the first hub 45 can include other shapes (e.g., square, triangular, octagonal, etc.) compatible to insert in the drive spindle 22 of the lock assembly 10. The first hub 45 includes an extension 60 for engaging the core cylinder 25. As shown in FIG. 2, one embodiment of the extension 60 includes a substantially asterisk shaped projection compatible for engaging the core cylinder 25. Of course, the shape of the extension can vary with the type of receiving receptacle of the core cylinder 25. In another embodiment, the first hub 45 can include a receptacle or cavity designed to receive an extension of the core cylinder 25.

The throw member 15 also includes a second hub 50 spaced laterally along the blade 40 from the first hub 45. One embodiment of the second hub 50 is substantially cylindrical-shaped similar to the first hub 45 described above. And like the first hub 45, the second hub 50 has a diameter that substantially fills the interior or cavity of the drive spindle 22. By filling the interior of the drive spindle 22, the first 45 and second 50 hubs provide enhanced internal support to resist a crushing force applied by a vandal in an attempt to collapse the drive spindle 22 and remove the lever and/or core cylinder 25. Thereby, the throw member 15 of the invention prevents unauthorized removal of the lever and core cylinder 25.

The distance between the first 45 and second 50 hubs forms a channel 62 designed to receive a catch 65. The catch 65 constrains the throw member 15 from moving laterally along the drive spindle 22. Thereby, the throw member 15 does not come loose if the door lever and/or core cylinder 25 are removed or exchanged. Thus, the throw member 15 of the invention reduces the problem with components of the lock assembly 10 coming loose during shipment or the exchange of the door lever and/or core cylinder 25. In one construction of the invention, the catch 65 constrains the door lever to the lock assembly as well as constrains the throw member 15 in the drive spindle 22. When the throw member 15 is rotated, the notch 68 allows the catch 65 to be depressed such that the door lever can be removed or exchanged without releasing the throw member 15. The shape (e.g., angular, square, etc.) and depth of the notch 68 can vary to receive the catch 65 and is not limiting on the invention.

The second hub 50 includes a passage or slot 70 for release from the catch 65. During installation of the throw member 15 in the lock assembly 10, the passage 70 enables the throw member 15 to be dropped in the drive cylinder 22 and rotated to allow the catch 65 to pass. Likewise, the throw member 15 can be readily removed by rotating the throw member 15 until the passage 70 in the second hub 50 aligns with the catch 65 to release the throw member 15. Thereby, removal of the throw member 15 does not require any special tools.

As shown in FIG. 1, the throw member 15 is positioned in the drive spindle 22 of the lock assembly. The drive spindle 22 rotates to extend and retract the latch (not shown) of the lock assembly. The drive spindle 22 is designed with a portion removed to allow persons to access and rotate the throw member 15 while assembling or disassembling the lock assembly 10. Yet, the drive spindle 22 is also designed to enclose the throw member 15 to provide enhanced protection from damage by vandals. A spring cage 72 encloses the drive spindle 22 against a door (not shown).

As noted above, the throw member 15 couples a core cylinder 25 with the key cam 35 in the chassis located in the bore of the door. One embodiment of the door lever and core cylinder 25 includes a key mechanism or key hole. One embodiment of the key mechanism includes a plurality of chambers 75 containing tumbler pins 77 that coordinate with a key 32 to enable the lock assembly 10 to be locked and unlocked. The tumbler pins 77 are positioned in accordance with the profile of the key 32. If the profile of the key 32 matches the settings of the tumbler pins 77, a user is allowed to rotate the key 32 and the key cam 35 of the chassis to unlock the lock assembly 10. In one construction, the user can retract the latch without unlocking the lock assembly. The core cylinder 25 further includes a cap 80 that receives the extension of the throw member 15. The extension of the throw member 15 can be designed to include a shape compatible with various types of caps for the core cylinders and is not limiting on the invention.

To remove the lever and core cylinder 25 requires a special extraction key 32 compatible with the positions of the tumbler pins 77. In one embodiment, upon inserting the extraction key 32 in the key mechanism of the core cylinder 25, one can rotate the key 32 toward a certain threshold angle of rotation such that a knob catch can be depressed and the lever and core cylinder 25 can be removed. In an alternative embodiment, the lever can include an exchangeable core cylinder 25 that can be withdrawn without removing the lever. To remove the exchangeable core cylinder 25, an operator inserts the extraction key 32 in the key mechanism and rotates the core cylinder 25 toward a threshold angle for removal. Upon rotating the extraction key 32 and core cylinder 25 toward the threshold angle, the core cylinder 25 can be withdrawn and exchanged for another core cylinder 25. Thereby, the core cylinder 25 can be exchanged without removing the lever or throw member 15. Of course, other means can be used to exchange the core cylinder 25 and is not limiting on the invention. Removing the core cylinder 25 and/or door lever provides access to the throw member 15. However, removing the core cylinder 25 or door lever does not release the throw member 15 or allow it to come loose. The throw member 15 is still retained in the drive spindle 22 by the catch 65 positioned between the first 45 and second 50 hubs. Thereby, the core cylinder 25 and/or door lever can be exchanged without causing other miscellaneous components of the lock assembly 10 to come loose.

Thus, the invention provides, among other things, an exemplary lock assembly having a self-contained throw member. Various features and advantages of the invention are set forth in the following claims.

What is claimed is:

1. A throw member for a lock assembly, the throw member comprising:

a blade having a first end and a second end, the first end for engaging a key cam of a chassis operable in retracting a latch of the lock assembly;

a first hub located at the second end of the lock assembly;

a second hub located at a distance along the blade apart from the first hub; and an extension to the first hub for engaging a core cylinder having a key mechanism, wherein rotation of a key inside the key mechanism of the core cylinder rotates the throw member and the key cam of the chassis in retracting the latch of the lock assembly; and wherein the throw member is located in a drive spindle that rotates to extend and retract the latch.

2. The throw member as claimed in claim 1, wherein the first and second hubs are sized to substantially fill the interior of the drive spindle.

3. The throw member as claimed in claim 1, wherein the distance between the first and second hubs is for receiving a catch that constrains the throw member from sliding in the drive spindle.

4. The throw member as claimed in claim 3, wherein the second hub includes a passage for release from the catch.

5. The throw member as claimed in claim 1, wherein removal of the core cylinder provides access to the throw member.

6. A throw member for a lock assembly, the throw member comprising:

a blade having a first end and a second end, the first end for engaging a key cam of a chassis operable in retracting a latch of the lock assembly;

a first hub located at the second end of the lock assembly;

a second hub located at a distance along the blade apart from the first hub; and an extension to the first hub for engaging a core cylinder having a key mechanism, wherein rotation of a key inside the key mechanism of the core cylinder rotates the throw member and the key cam of the chassis in retracting the latch of the lock assembly, and wherein the core cylinder is interchangeable without releasing the throw member from the catch.

7. A throw member for a lock assembly, the throw member comprising:

a blade having a first end and a second end, the first end for engaging a key cam of a chassis operable in retracting a latch of the lock assembly;

a first hub located at the second end of the lock assembly;

a second hub located at a distance along the blade apart from the first hub; and an extension to the first hub for engaging a core cylinder having a key mechanism, wherein rotation of a key inside the key mechanism of the core cylinder rotates the throw member and the key cam of the chassis in retracting the latch of the lock assembly, and wherein the blade is square-shaped for engaging the lock assembly.

8. A lock assembly for a door, the lock assembly comprising:

a latch assembly having a chassis with a key cam operable in locking and unlocking the lock assembly;

a door lever having a core cylinder with a key mechanism;

a drive spindle that connects the door lever to the latch assembly, wherein rotation of the lever and spindle extends and retracts the latch;

a throw member positioned in the drive spindle, the throw member having a first and second hub positioned along a blade, wherein a first end of the throw member engages the core cylinder and a second end of the throw member engages the key cain, and wherein rotation of a key inside the key mechanism of the core cylinder is operable in rotating the throw member and key cam in locking and unlocking the lock assembly.

9. The lock assembly of as claimed in claim 8, wherein the first and second hubs are substantially cylindrical-shaped.

10. The lock assembly of as claimed in claim 8, wherein the first and second hubs are sized to substantially fill the interior of the drive spindle.

11. The lock assembly as claimed in claim 8, wherein the first and second hubs are at a distance apart to receive a catch that constrains the throw member from sliding in the drive spindle.

12. The lock assembly as claimed in claim 10, wherein the core cylinder is interchangeable without release of the throw member from the catch.

13. The lock assembly as claimed in claim 11, wherein the second hub includes a passage for release of the throw member from the catch.

14. The lock assembly as claimed in claim 8, wherein removal of the core cylinder provides access to the throw member.

15. The lock assembly as claimed in claim 8, wherein the blade is substantially square-shaped.

16. The lock assembly as claimed in claim 8, wherein the first hub includes an extension shaped to engage a cap of the core cylinder.

17. The lock assembly as claimed in claim 8, wherein a portion of the drive spindle is removed to provide access to the throw member.

18. The lock assembly as claimed in claim 11, wherein the catch constrains the door lever to the lock assembly, and wherein the throw member includes a notch that allows the catch to be depressed such that the door lever can be removed from the lock assembly without releasing the throw member.

19. The lock assembly as claimed in claim 18, wherein the notch is formed in the first and second hubs of the throw member.

* * * * *